US009256151B2

(12) United States Patent
Tanaka

(10) Patent No.: US 9,256,151 B2
(45) Date of Patent: Feb. 9, 2016

(54) PRINTING APPARATUS AND CONTROLLING METHOD

(71) Applicant: CANON KABUSHIKI KAISHA, Tokyo (JP)

(72) Inventor: Hirotomo Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 34 days.

(21) Appl. No.: 13/950,754

(22) Filed: Jul. 25, 2013

(65) Prior Publication Data

US 2014/0037301 A1 Feb. 6, 2014

(30) Foreign Application Priority Data

Aug. 2, 2012 (JP) ..... 2012-172300
Aug. 2, 2012 (JP) ..... 2012-172301

(51) Int. Cl.

| | |
|---|---|
| ***B41J 29/38*** | (2006.01) |
| ***G03G 15/00*** | (2006.01) |
| ***G03G 21/00*** | (2006.01) |
| ***G03G 13/16*** | (2006.01) |
| ***G03G 15/16*** | (2006.01) |

(52) U.S. Cl.

CPC ..... *G03G 13/16* (2013.01); *G03G 15/1695* (2013.01); *G03G 15/6558* (2013.01)

(58) Field of Classification Search

CPC ..... G03G 2215/00531; G03G 2215/00708; G03G 15/1695; G03G 15/657; B65H 2301/5115; B41M 5/0011

USPC ..... 399/390, 322; 400/120.18

See application file for complete search history.

(56) References Cited

U.S. PATENT DOCUMENTS

| | | | | |
|---|---|---|---|---|
| 5,465,135 | A * | 11/1995 | Nakagama et al. | 399/44 |
| 2008/0038039 | A1 * | 2/2008 | Watase et al. | 400/642 |
| 2010/0111546 | A1 * | 5/2010 | Kubo | 399/16 |
| 2013/0136478 | A1 * | 5/2013 | Matsumoto | G03G 21/0005 399/67 |

FOREIGN PATENT DOCUMENTS

| | | | | |
|---|---|---|---|---|
| JP | 07074972 | A * | 3/1995 | G03G 15/01 |
| JP | 2007-286108 | A | 11/2007 | |

* cited by examiner

*Primary Examiner* — Daniel J Colilla
*Assistant Examiner* — Ruben Parco, Jr.
(74) *Attorney, Agent, or Firm* — Fitzpatrick, Cella, Harper & Scinto

(57) ABSTRACT

If the elapsed time since a sheet was stored in a sheet storage unit is less than or equal to a threshold value, control is performed such that the sheet is heated by a fixing unit before an image is transferred to the sheet, and if the elapsed time since the sheet was stored in the sheet storage unit exceeds the threshold value, control is performed such that processing for heating the sheet with the fixing unit before the image is transferred to the sheet is not performed.

8 Claims, 16 Drawing Sheets

FIG. 8

| CASSETTE NAME | MODEL (805) | PAPER FEED TRAY OPEN (806) | FINGERPRINT REMOVAL MODE (801) | SHEET TYPE | REMAINING SHEET AMOUNT (802) | ADDED SHEET AMOUNT (803) | ELAPSED TIME (804) |
|---|---|---|---|---|---|---|---|
| MANUAL PAPER FEED | MANUAL | Open | ON | NORMAL PAPER 1 | | ON | 1 MIN (13:24) |
| BUILT-IN CASSETTE 1 | INVERSION CASSETTE | Close | ON | NORMAL PAPER 2 | 100% | 10% | 5 MIN (13:20) |
| BUILT-IN CASSETTE 2 | INVERSION CASSETTE | Close | ON | RECYCLED PAPER | 60% | - | 3 DAYS |
| POD DECK 1 | MANUAL | Close | ON | COATED PAPER | 10% | - | 4 DAYS |
| POD DECK 2 | MANUAL | Close | OFF | COLOR PAPER | 20% | - | OVER 1 WEEK |
| POD DECK 3 | MANUAL | Close | ON | NORMAL PAPER 1 | 90% | - | OVER 1 WEEK |
| : | : | : | | : | : | : | : |

800

FIG. 11

1100

| NAME | TYPE (1101) | FINGERPRINT REMOVAL TIME A (MIN) (1102) |
|---|---|---|
| SK80 | NORMAL PAPER | 30 |
| SK105 | NORMAL PAPER | 40 |
| SK157 | NORMAL PAPER | 20 |
| SK209 | NORMAL PAPER | 15 |
| GLOSSY COATED PAPER A4 | COATED PAPER | 15 |
| HEAVY COATED PAPER 142 gsm | COATED PAPER | 10 |
| ⋮ | ⋮ | ⋮ |

PRINTING APPARATUS AND CONTROLLING METHOD

BACKGROUND OF THE INVENTION

1. Field of the Invention

The present invention relates to a printing apparatus that performs processing for removing fingerprints left on a printing medium, and a method of controlling the same.

2. Description of the Related Art

Grease and moisture from the human body causes a reduction in resistivity in portions of a sheet that come into contact with a fixer, and there are cases where, for example, they cause a transfer failure when toner is transferred to the sheet, thus resulting in fingerprint marks being left on the printing result as shown by reference sign 1601 in FIG. 16. In order to address such a defect in a fixed image, there is known to be an image forming apparatus that has a fingerprint removal mode function for removing fingerprint marks by causing a sheet with fingerprints on it to pass through the fixer one time before printing in order to remove the oil component of the fingerprints on the sheet (Japanese Patent Laid-Open No. 2007-286108). Japanese Patent Laid-Open No. 2007-286108 discloses that the image forming apparatus removes smudging such as a fingerprint mark by executing pre-fixing on sheets fed to the manual paper feed tray. Japanese Patent Laid-Open No. 2007-286108 further discloses that a user can enable/disable the fingerprint removal function using an operation unit.

In Japanese Patent Laid-Open No. 2007-286108, the fingerprint removal mode is set using the operation unit of the image forming apparatus when printing sheets have been fed to the manual paper feed tray. For this reason, when the fingerprint removal mode is set, printing is performed in the fingerprint removal mode until all of the sheets set in the manual paper feed tray are gone. Since the fingerprint removal mode involves operations in which printed matter is passed through the fixer one time before being printed on and then discharged, the printing speed is slower than that in normal printing.

Fingerprints left on a sheet actually gradually disappear as time passes. Although it depends on the type and thickness of the printing sheet, fingerprints on ordinary copy sheets disappear in approximately 30 minutes. Accordingly, there are cases where fingerprint removal does not need to be performed for printing sheets for which a long time has passed since being stored in the paper feed tray. Performing fingerprint removal in such case results in an unnecessary increase in the printing time.

SUMMARY OF THE INVENTION

An aspect of the present invention is to eliminate the above-mentioned problems with the conventional technology. The present invention provides a printing apparatus that shortens the printing time when employing the fingerprint removal mode, and a method of controlling the same.

The present invention in its first aspect provides a printing apparatus comprising: a printing unit configured to transfer an image to a sheet conveyed from a sheet storage unit and fix the transferred image to the sheet using a fixing unit; and a control unit configured to, if the elapsed time since the sheet was stored in the sheet storage unit is less than or equal to a threshold value, perform control such that the sheet is heated by the fixing unit before the image is transferred to the sheet, and if the elapsed time since the sheet was stored in the sheet storage unit exceeds the threshold value, perform control such that processing for heating the sheet with the fixing unit before the image is transferred to the sheet is not performed.

The present invention enables shortening the printing time when employing the fingerprint removal mode.

Further features of the present invention will become apparent from the following description of exemplary embodiments with reference to the attached drawings.

BRIEF DESCRIPTION OF THE DRAWINGS

FIG. 8 is a diagram showing a sheet type database saved in the image forming apparatus.

FIG. 11 is a diagram showing the sheet type database saved in the image forming apparatus.

DESCRIPTION OF THE EMBODIMENTS

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Note that like constituent elements will be denoted by like reference signs, and redundant descriptions thereof will not be given.

Embodiment 1

Configuration of Image Forming System

Figure 1:
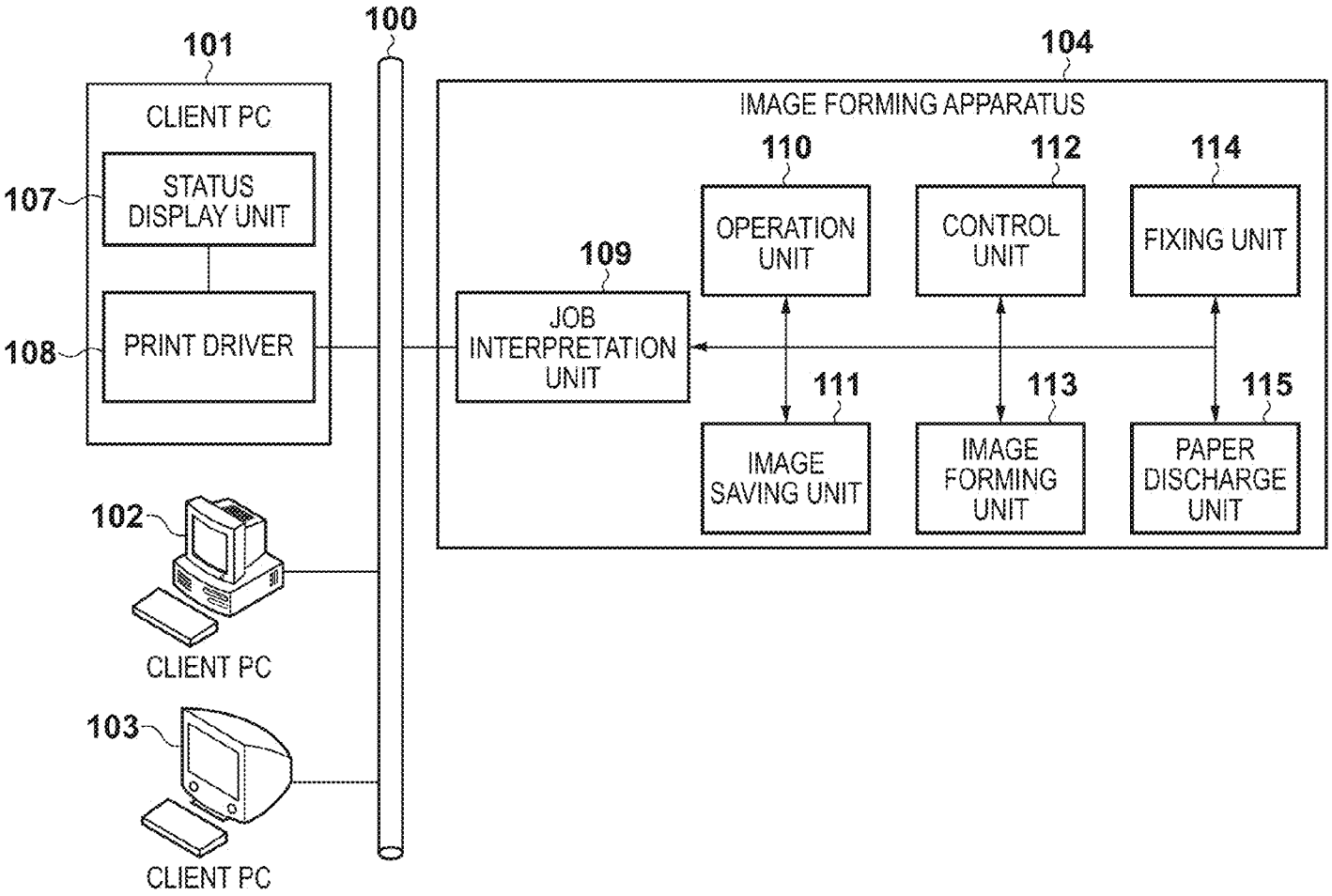
FIG. 1 is a diagram showing a configuration of an image forming system.

FIG. 1 is a diagram showing a configuration of an image forming system according to the present invention. In this image forming system, client PCs 101 to 103 and an image forming apparatus 104 are communicably connected to each other via a network 100. The client PCs 101 to 103 are general PCs (information processing apparatuses), for example. The image forming apparatus 104 is a printing apparatus that prints images and characters onto printing media (referred to hereinafter as "sheets") based on a received print job, for example. The client PCs 101 to 103 can receive, from the image forming apparatus 104, various types of information such as print errors and statuses that indicate the apparatus status of the image forming apparatus 104.

The client PCs 101 to 103 all have the same configuration. Although the following description is given for the client PC 101, it similarly applies to the client PCs 102 and 103 as well. As modules, the client PC 101 implements a print driver 108 and a status display unit 107 that displays the status of the image forming apparatus 104. Although the status display unit 107 is implemented so as to be included in the print driver 108 in the following description, it may be implemented separately from the print driver 108 as shown in FIG. 1.

Figure 2:
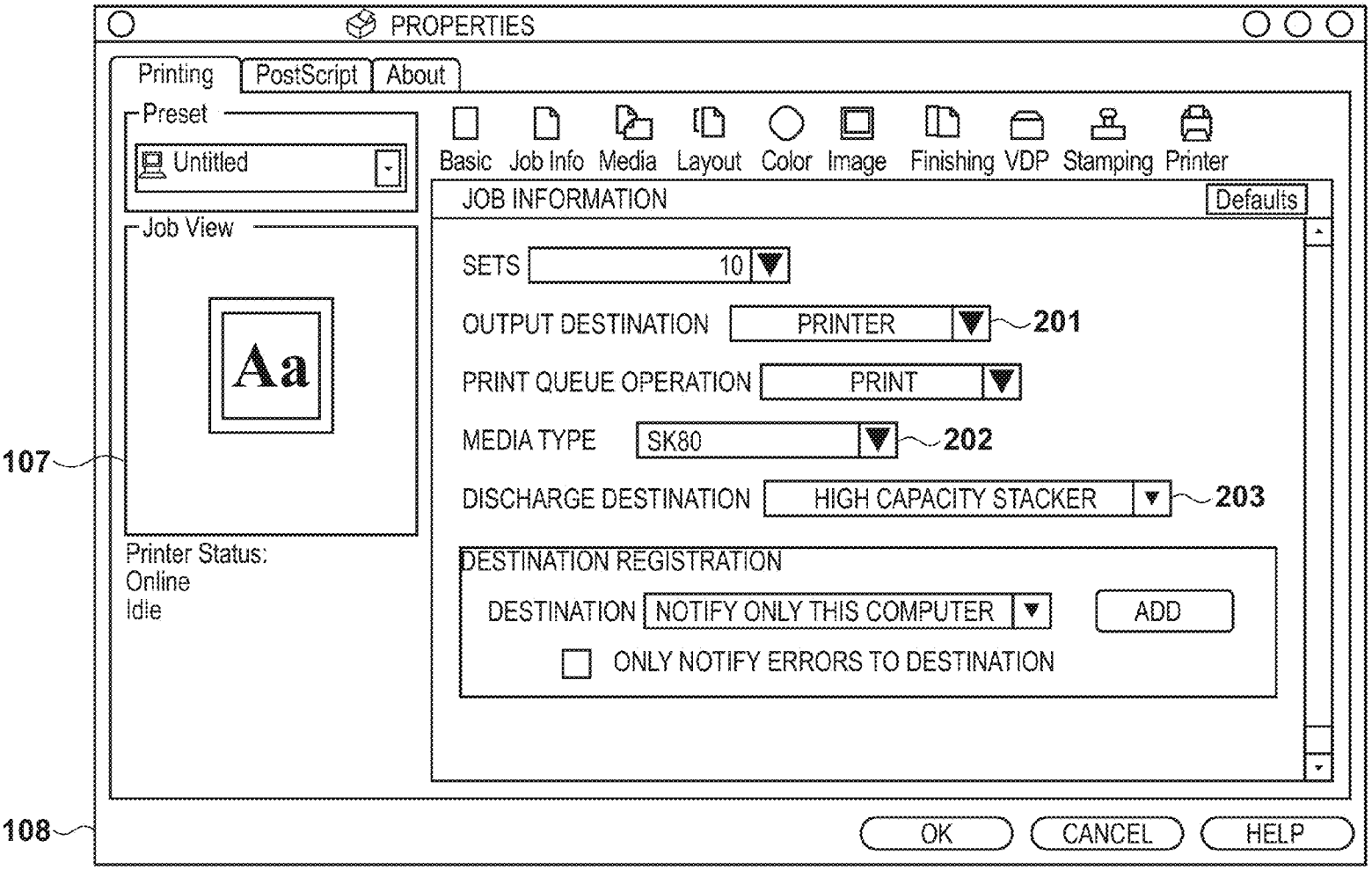
FIG. 2 is a diagram showing a print driver setting screen.

FIG. 2 is a diagram showing an example of a setting screen of the print driver 108 on the client PC 101. Print drivers 108 that respectively correspond to the image forming apparatuses 104 that perform printing are implemented in the client PC 101 in advance, and the user selects the print driver 108 for the desired image forming apparatus 104, and inputs a print job. The print driver 108 can receive a designation of multiple output destinations 201 from the user. The multiple output destinations 201 referred to here are a printer, a user box, and secure printing. In the case of outputting printing matter from the image forming apparatus 104, the user designates "printer" as the output destination 201. Also, in the case of saving print job data in the image forming apparatus 104, the user designates "user box" as the output destination 201. The print driver 108 can switch the print job processing in the image forming apparatus 104 according to the output destination 201 designated by the user.

The status display unit 107 displays a status indicating the apparatus status of the image forming apparatus 104 on a screen of the client PC 101 so as to notify the user. Here, the status display unit 107 displays statuses of the image forming apparatus 104 such as "idling", "printing", and "toner shortage", as well as printer error statuses such as "no paper" and "paper jam". The status display unit 107 can acquire the status of a registered image forming apparatus 104 at any time by requesting the status from that image forming apparatus 104 at a constant time interval. Also, the status display unit 107 periodically updates the display of the status of the image forming apparatus 104 based on the results of the status request. The user can therefore determine whether or not a print job can be input based on the up-to-date display of the status of the image forming apparatus 104.

Block Configuration of Image Forming Apparatus

A printing apparatus is described as an example of the image forming apparatus in the present embodiment. The image forming apparatus 104 may be, for example, an apparatus that has functions other than printing, such as a multifunction device in which multiple functions such as copy and scanning are integrated. A printing apparatus that has at least a printing configuration and a configuration for receiving user operations is used as the image forming apparatus 104 of the present embodiment. The image forming apparatus 104 receives a print job input by the client PC 101, and executes printing based on the print job. As shown in FIG. 1, the image forming apparatus 104 includes multiple function blocks, namely a control unit 112, a job interpretation unit 109, an image forming unit 113, an image saving unit 111, a fixing unit 114, an operation unit 110, and a paper discharge unit 115. Note that among the various configurations of an ordinary image forming apparatus, FIG. 1 shows only portions related to operations that realize the present embodiment.

Control Unit 112

The control unit 112 includes a CPU, a ROM, a RAM, and an HDD. The control unit 112 starts an operating system (OS) with a boot program stored in the ROM, and executes various types of processing by executing application programs saved in the HDD on the OS. The control unit 112 controls various units, and performs print processing while cooperating with other units based on a print job saved in the image saving unit 111. Information regarding a sheet size, a sheet type, a paper feed tray (sheet storage unit), and a paper discharge tray is described in a print job, and the control unit 112 executes the print job based on such information. The control unit 112 also saves PDL code described in the print job to the image saving unit 111.

Job Interpretation Unit 109

A print job is described in a printer language called PDL code. Print jobs input from the client PC 101 via the network 100 are interpreted by the job interpretation unit 109 in the order of input. The job interpretation unit 109 interprets information such as a sheet size, a sheet type, a paper feed tray, and a paper discharge tray, and saves the interpreted information in the image saving unit 111 in association with the print job. A flag indicating whether the data to be output is character data or image data is also set in the print job. Although this will be described later, the job interpretation unit 109 reads this flag and selects the print mode in which print processing is to be executed.

Image Forming Unit 113

The image forming unit 113 generates image data based on the PDL code of an input print job. Processing for generating image data from PDL code is generally called rasterizing (or RIP). As described above, a flag indicating whether the data to be output is character data or image data is set in the print job. The image forming unit 113 performs edge filter processing on character data so that character edges have a good appearance. The image forming unit 113 performs smoothing filter processing on image data so as to obtain a smooth image compared to peripheral pixels.

Image Saving Unit 111

The image saving unit 111 is configured by a memory, an HDD, or the like, and temporarily saves rasterized image data generated by the image forming unit 113 until processing is performed by the fixing unit 114. The image saving unit 111 also saves interpretation results of the job interpretation unit 109 in association with rasterized image data in units of jobs. Also, the image saving unit 111 saves print jobs input from the client PC 101 as PDL code as well. The image saving unit 111 further saves a paper feed tray database 800 shown in FIG. 8 and a sheet type database 1100 shown in FIG. 11, which will be described later.

Operation Unit 110

Figure 3:
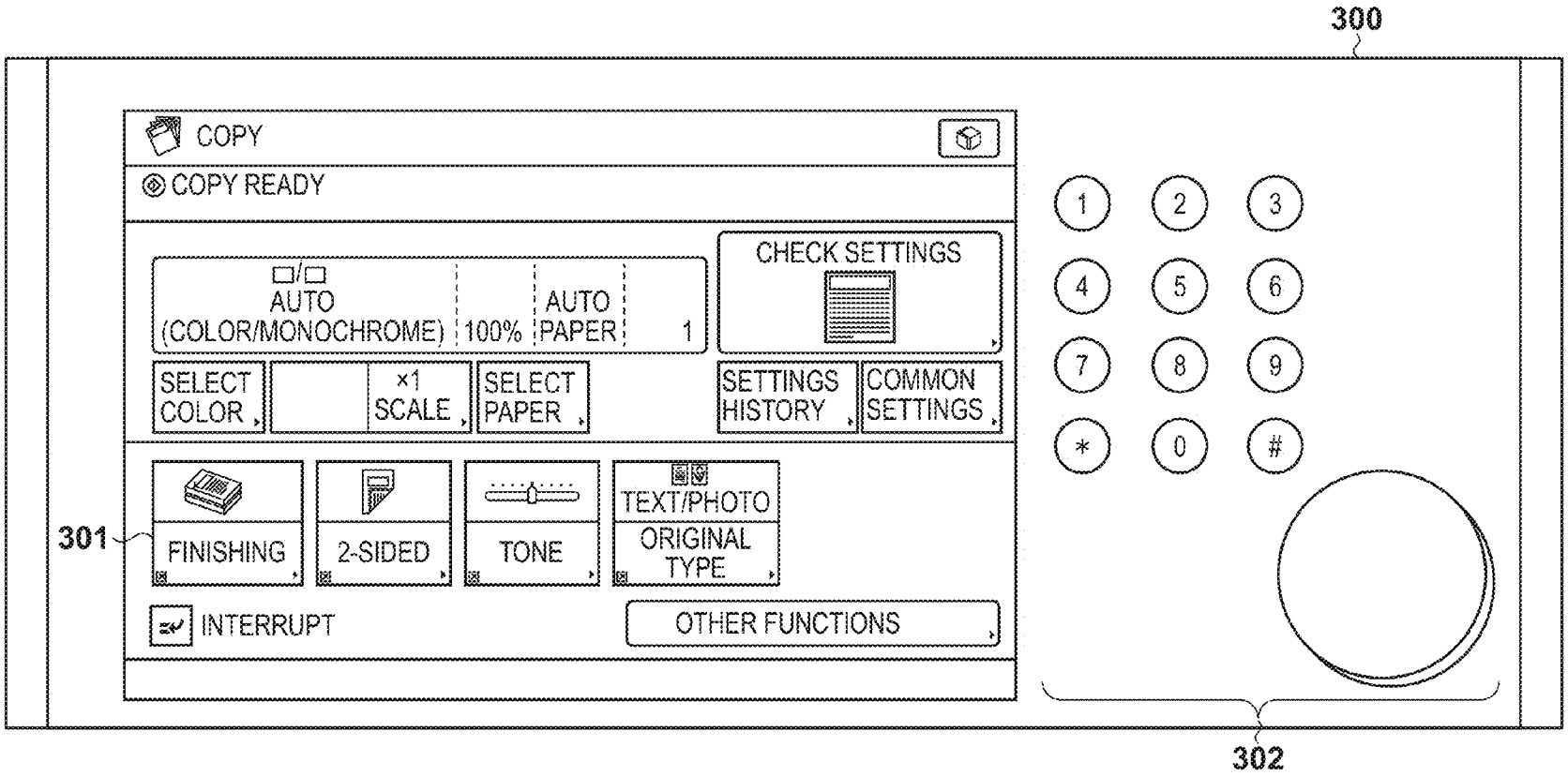
FIG. 3 is a diagram showing an operation unit of an image forming apparatus.

FIG. 3 is a diagram showing an example of the operation unit 110 of the image forming apparatus 104. The operation unit 110 is configured by a touch panel on a liquid crystal display (LCD), for example. When buttons 301 displayed on an operation screen being displayed are pressed by the user, information corresponding to the pressed buttons is transmitted to the control unit 112. In addition to the LCD, a start key, a stop key, a numerical keypad, and the like are configured as hard keys 302 of the operation unit 110.

Figure 4:
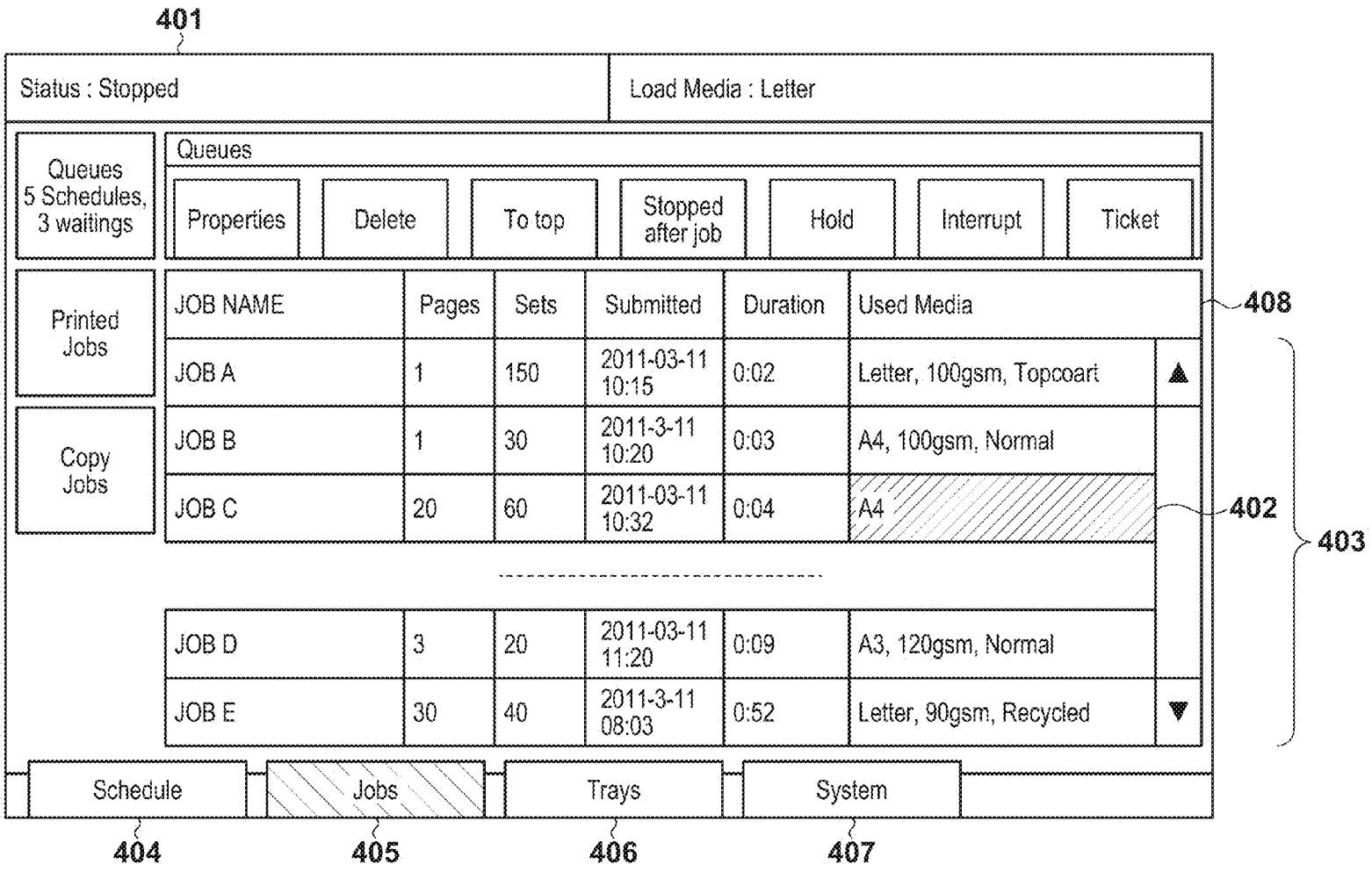
FIG. 4 is a diagram showing an operation screen displayed on the operation unit.

FIG. 4 is a diagram showing an example of the operation screen displayed on the operation unit 110. Buttons allowing the user to select various types of functions are displayed as touch keys in the bottom portion of the operation screen. Examples of the displayed buttons include a schedule tab 404 for managing a schedule of print jobs input to the image forming apparatus 104, and a jobs tab 405 for managing and displaying information regarding various types of jobs such as print jobs and copy jobs. Other displayed buttons include a trays tab 406 for displaying paper feed tray statuses and for performing the setting of, for example, the type of printing medium (e.g., printing sheet), and a system tab 407 for performing system management of the image forming apparatus 104.

Fixing Unit 114

Figure 5:
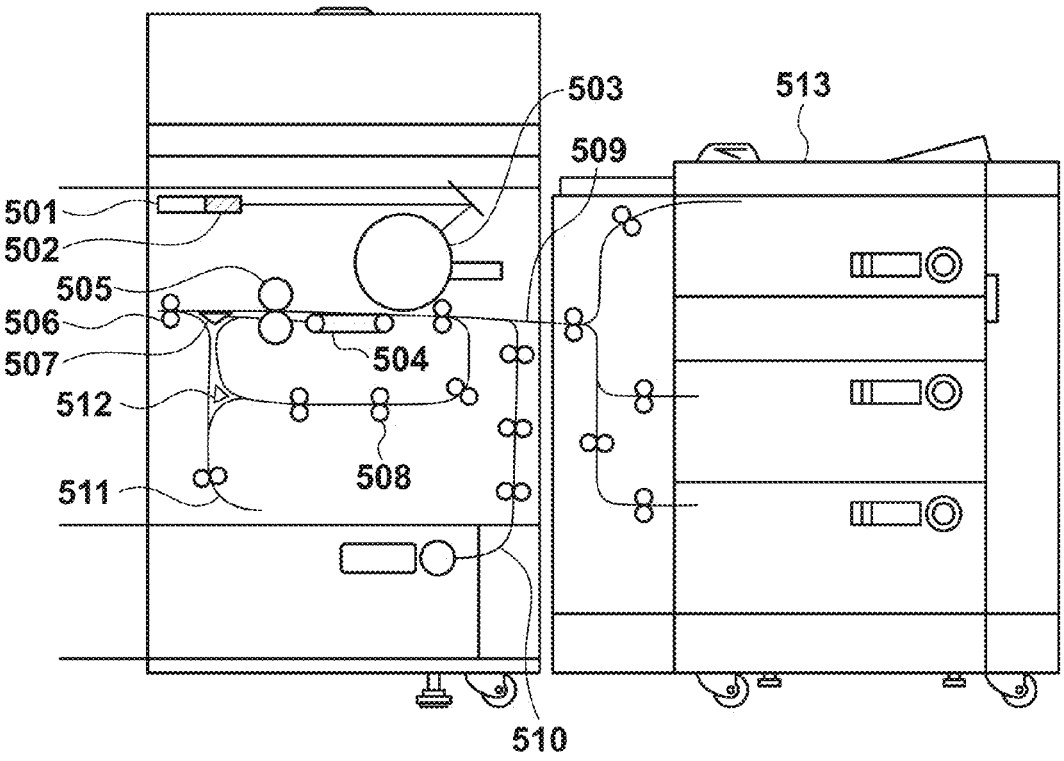
FIG. 5 is a diagram showing a configuration of the periphery of a fixing unit of the image forming apparatus.

FIG. 5 is a diagram showing a configuration of the periphery of the fixing unit 114 of the image forming apparatus 104. The fixing unit 114 fixes a print image to a sheet based on rasterized image data saved in the image saving unit 111. A laser driver 501 of the fixing unit 114 drives a laser emitting unit 502 based on image data input from the control unit 112. Accordingly, a laser beam modulated according to the image data is emitted from the laser emitting unit 502. The laser beam is emitted onto a photosensitive drum 503 while being scanned. An electrostatic latent image is formed on the photosensitive drum 503 by the emitted laser beam, and the electrostatic latent image is visualized as a toner image using toner supplied from a developer. In synchronization with the laser beam emission timing, a sheet from one of the paper feed trays is supplied between the photosensitive drum 503 and a transfer unit 504 via a conveyance path, and the toner image on the photosensitive drum 503 is transferred onto the fed sheet by the transfer unit 504.

In the present embodiment, sheets are supplied from a manual paper feed portion and three levels of POD decks included in a high capacity sheet feeding deck 513, via a conveyance path 509 to the right of the photosensitive drum. Note that the manual paper feed portion is mounted in place of the high capacity sheet feeding deck 513 when the high capacity sheet feeding deck 513 has been detached. Also, sheets are supplied from a built-in cassette via a conveyance path 510 below the photosensitive drum. A sheet with a toner image transferred thereon is conveyed to a pair of fixing rollers 505 by the driving of a conveyance belt. The pair of fixing rollers is configured as a pair made up of a heating roller and a pressing roller. The pair of fixing rollers 505 heats and presses the printing medium, thus fixing the toner image on to the sheet. After passing through the pair of fixing rollers 505, the sheet is discharged to a paper discharge accessory by a pair of paper discharge rollers 506. The paper discharge accessory is an apparatus that executes post-processing (also called "finishing") such as sorting and stapling.

Here, in the case where the image forming apparatus 104 operates in a later-described fingerprint removal mode, fingerprints are removed by applying heat with the fixing unit 114 to a supplied sheet one time before printing (pre-print processing), and then the sheet subjected to fixing is turned back by a flapper 507 and guided to a paper re-feed conveyance path 508. On the other hand, in the case where double-sided printing in particular has been designated in a normal print mode, the sheet is guided by the flapper 507 to an inverting path 511. The sheet conveyed along the inverting path 511 is then guided by the flapper 512 to the paper re-feed conveyance path 508. The printing medium guided to the paper re-feed conveyance path 508 is then re-supplied between the photosensitive drum 503 and the transfer unit 504 at predetermined timing, and a toner image is transferred onto the underside of the sheet.

In this way, in the present embodiment, the conveyance path in the case of the fingerprint removal mode and the conveyance path in the case of the double-sided printing are switched by an instruction from the control unit 112.

Paper Discharge Unit 115

The paper discharge unit 115 discharges sheets subjected to fixing by the fixing unit 114 in the order set in the print job. The image forming apparatus 104 can apply various paper discharge accessories according to the finishing mode set in the print job. Also, the control unit 112 can reference various types of information on paper discharge accessories saved in the image forming apparatus 104, determine the paper discharge functions that can be performed, and display those finishing modes on the operation unit 110.

When a print job is input from the client PC 101, the job interpretation unit 109 references information on the various paper feed trays. The control unit 112 references the information on the various paper feed trays from the paper feed tray database 800 saved in the image saving unit 111. The control unit 112 can switch the fingerprint removal mode and the normal print mode according to the information on the various paper feed trays. This will be described in detail later.

Job Management Screen

In the case of performing job management, the user presses the jobs tab 405 in the bottom portion of the operation screen. FIG. 4 shows the operation screen displayed at that time. Based on print jobs input from the client PC 101, the operation unit 110 displays the print jobs as a job list 403 arranged in order from the top in the central portion of the operation screen in FIG. 4. New jobs are added to the bottom of the job list 403. The job title, the number of pages, the number of sets, the job input time, the elapsed time, media (sheet) information, and the like are displayed as items 408 in the job list 403.

The current status of the image forming apparatus 104 is displayed as an item 401 in the top portion of the operation screen in FIG. 4. In FIG. 4, "Stopped" is displayed as the status. In the present embodiment, the operation screen in FIG. 4 is displayed at the stage immediately before printing is temporarily stopped and a paper feed tray is assigned to the print job. The type of sheet to be used in the print job, the grammage, the size, and the like are displayed as media information on the right side in the job list 403. A newly input print job is displayed in the job list 403 along with the attached sheet information.

As previously described, the print driver 108 of the client PC 101 receives, from the image forming apparatus 104, printing errors and various types of information on paper feeding, paper discharge accessories, and the like. Information in the sheet type database 1100 (described later) in FIG. 11 that is saved in the image saving unit 111 is also received by the print driver 108 from the image forming apparatus 104. Based on such information, the print driver 108 displays up-to-date information regarding the up-to-date correspondence between paper feed trays and sheets in the image forming apparatus 104. The print driver 108 attaches media information selected by the user to a print job, and transmits the print job to the image forming apparatus 104. In the case where sheets corresponding to the sheet type attached to the print job are associated with a paper feed tray at the time of printing based on the print job, the control unit 112 performs printing on such sheets. On the other hand, in the case where sheets corresponding to the sheet type attached to the print job are not associated with a paper feed tray, the control unit 112 temporarily stops printing. At that time, the user associates a type of printing medium and a paper feed tray in order to perform printing. When the user then presses the portion of the media information 408 on the right side in the job list 403 on the operation screen in FIG. 4, the operation unit 110 displays a paper feed tray selection screen 500 for associating a sheet type and a paper feed tray with each other.

Paper Feed Tray Setting

Figure 6:
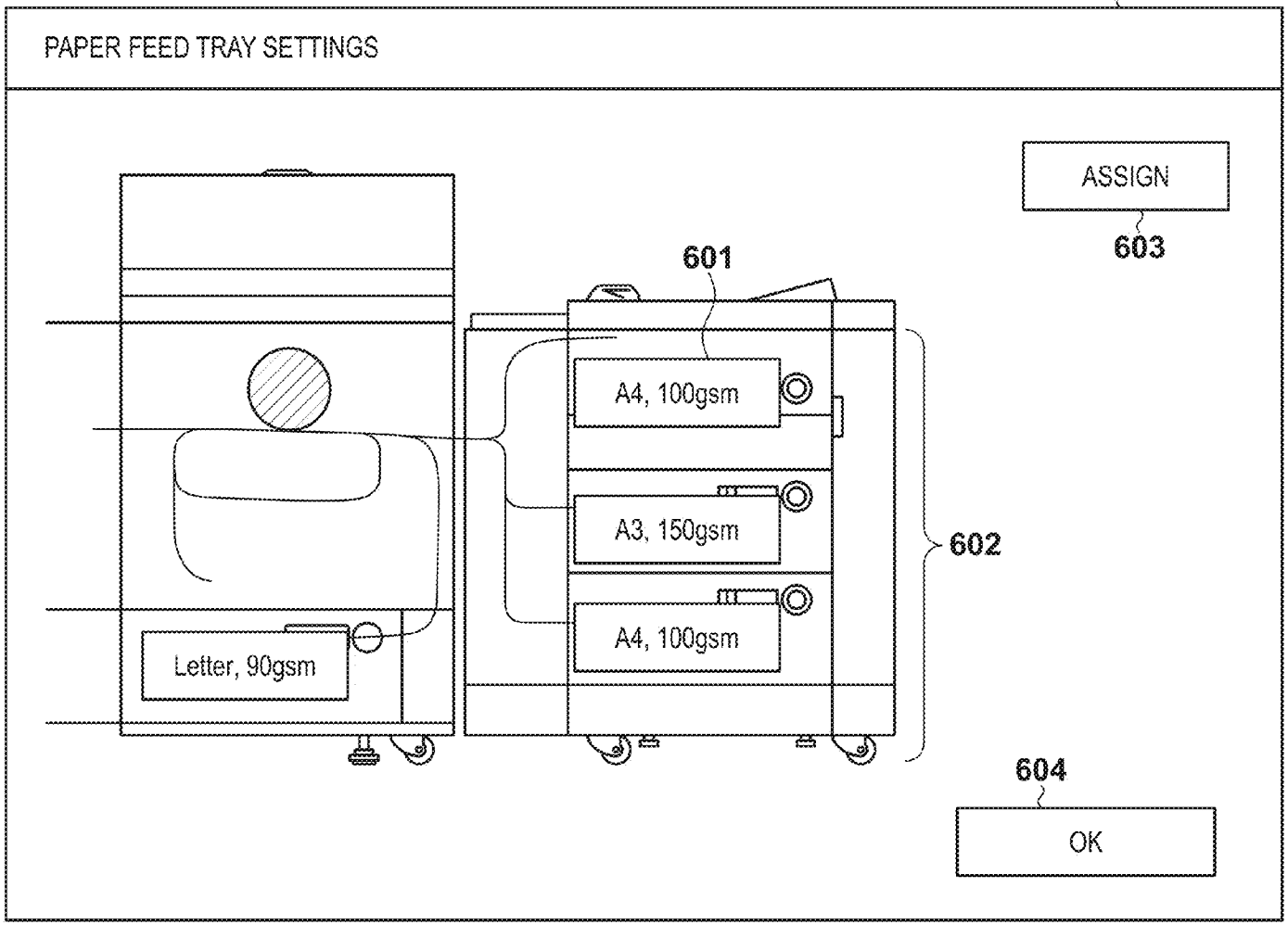
FIG. 6 is a diagram showing a paper feed tray selection screen displayed on the operation unit.

FIG. 6 is a diagram showing an example of a paper feed tray setting screen 600 displayed on the operation unit 110 of the image forming apparatus 104. The setting screen 600 is displayed if the user presses the trays tab 406 on the operation screen in FIG. 4. Paper feed accessory information 602 regarding paper feed accessories configured in the image forming apparatus 104 is displayed on the paper feed tray setting screen 600. The paper feed accessory information 602 is displayed in correspondence with the positions where the actual paper feed accessories are configured.

In the case where the user is to add or newly replenish sheets in a paper feed tray, the user selects a paper feed tray button 601 on the setting screen 600 by pressing it, and then presses an assign button 603. The paper feed tray button 601 and the accessories arranged in the image forming apparatus 104 are coordinated, and the control unit 112 opens the cassette of the paper feed accessory at the same position as the button pressed by the user. The user then adds or newly replenishes sheets to be used for printing in the open paper feed tray, and then closes the cassette. When the control unit 112 detects that the paper feed tray cassette was closed using a sensor or the like, the control unit 112 displays a sheet media setting screen on the operation unit 110.

Figure 7:
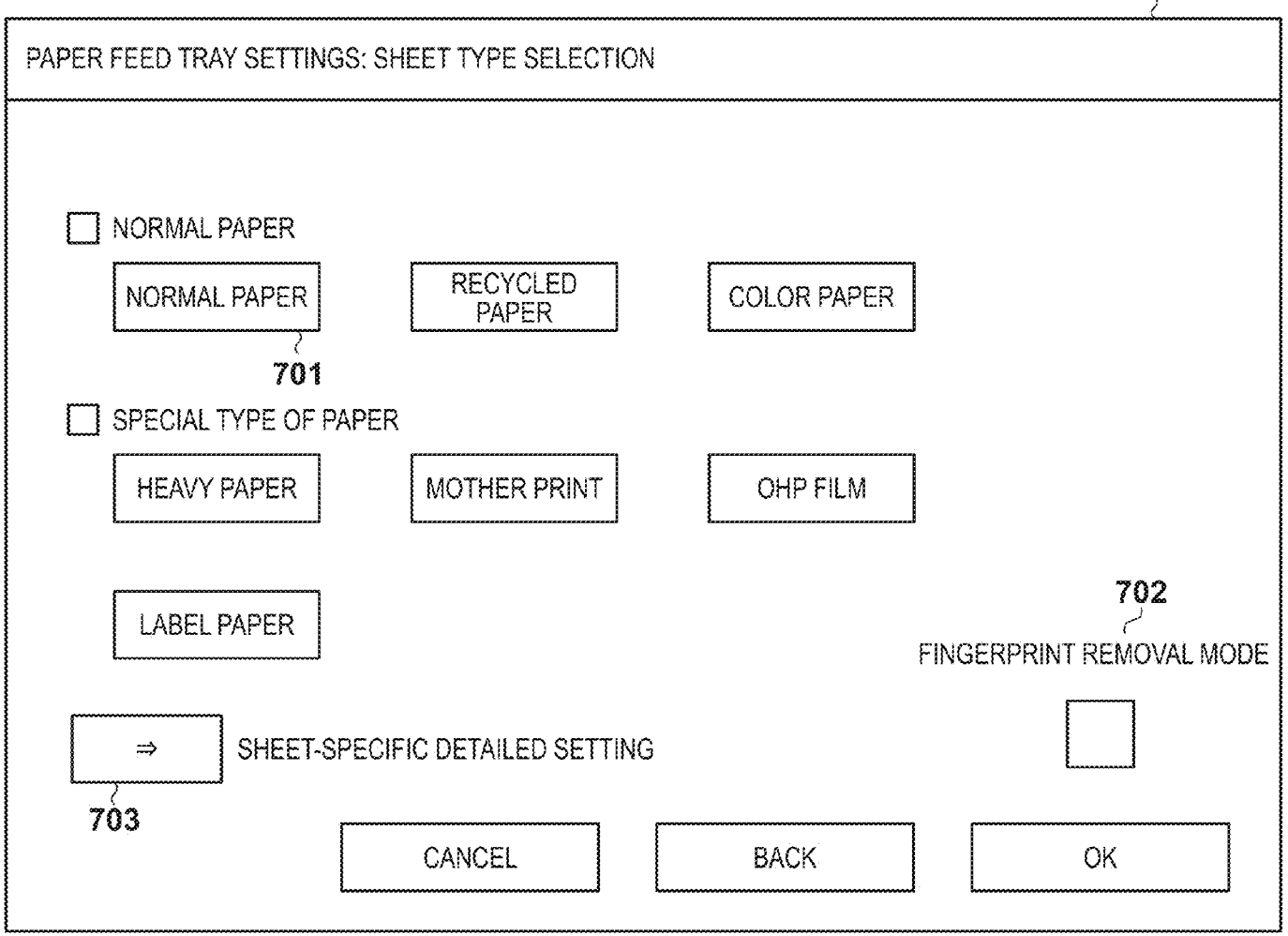
FIG. 7 is a diagram showing a sheet media setting screen displayed on the operation unit.

FIG. 7 is a diagram showing an example of the sheet media setting screen displayed on the operation unit 110 of the image forming apparatus 104. A sheet media setting screen 700 is a screen for setting the type and weight of the sheet set in the paper feed tray by the user. Pre-provided items 701 such as normal paper, recycled paper, and color paper can be assigned to the paper feed tray by the user. Also, regarding the sheet size displayed on the setting screen 700, the control unit 112 can detect the sheet size based on the position of a guide placed against the side of the sheets in the paper feed tray. The operation unit 110 displays a fingerprint removal mode ON/OFF button 702 on the sheet media setting screen 700. By setting to the button 702 to "ON", the user can cause the image forming apparatus 104 to operate in the fingerprint removal mode when printing is to be performed on the sheets supplied from that paper feed tray. If the button 702 is set to "ON" by the user, a fingerprint removal mode item 801 for the paper feed tray in the paper feed tray database 800 saved in the image saving unit 111 is set to "ON" by the control unit 112.

Figure 9:
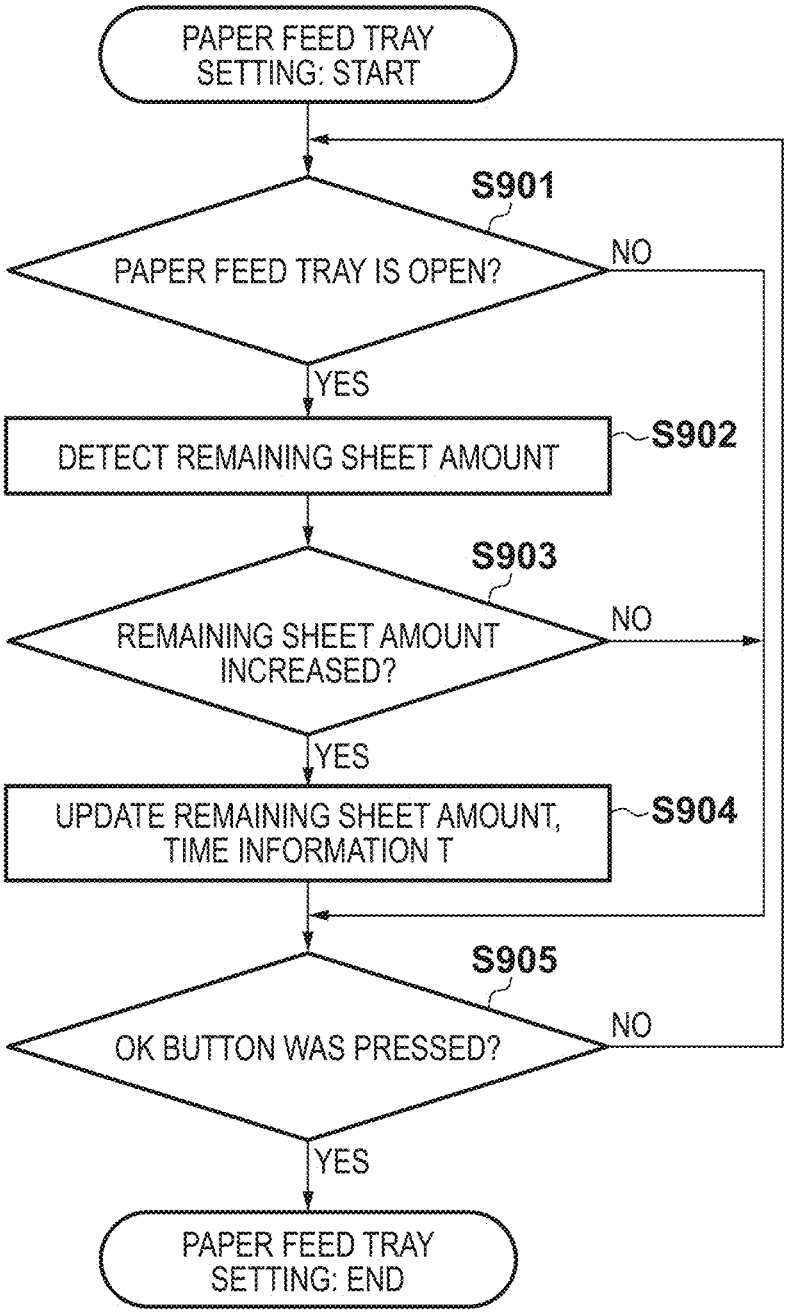
FIG. 9 is a flowchart showing a procedure of paper feed tray setting processing performed by the image forming apparatus according to an embodiment.

FIG. 9 is a flowchart showing a procedure of paper feed tray setting processing performed by the image forming apparatus 104 according to the present embodiment. The processing steps shown in FIG. 9 are executed by, for example, the CPU of the image forming apparatus 104 controlling various units of the image forming apparatus 104 shown in FIG. 1. The execution of this flowchart is started if the paper feed tray setting screen 600 is opened, or the trays tab 406 is pressed by the user.

If the user presses a paper feed tray button 601 and then presses an OK button 604, the control unit 112 opens the paper feed tray that corresponds to the paper feed tray button that was pressed (step S901). A sensor is disposed in each paper feed tray, and the control unit 112 can recognize that the paper feed trays have been opened or closed (one example of detection in replenishing). In order to store information indicating that the paper feed tray was opened, the control unit 112 sets a paper feed tray open item 806 in the paper feed tray database 800 to "Open". When the paper feed tray is opened, that is to say, when sheet replenishing is performed, the control unit 112 detects the remaining sheet amount in the paper feed tray (step S902). For each paper feed tray other than the manual paper feed tray, the control unit 112 can detect the remaining sheet amount as a percentage based on the percentage of 100% for the full state (one example of remaining amount detection). In particular, for a paper feed tray in which sheets are loaded with the printing surface face-down, the control unit 112 can, based on the remaining sheet amounts when the user opened the paper feed tray and when the user closed the paper feed tray, approximately specify how many sheets down from the top a sheet likely to have fingerprints left thereon is in the current sheet bundle.

All of the items in the paper feed tray database 800 stored in the image saving unit 111 are updated each time the information on the paper feed trays changes, such as when printing is performed and when sheets are replaced in the paper feed trays. Accordingly, up-to-date information regarding the paper feed trays is always saved in the paper feed tray database 800. First, based on the items 802 in the paper feed tray database 800, the control unit 112 acquires the remaining sheet amount for the paper feed tray to which the user desires to input sheets. Then, when the user closes the paper feed tray, the control unit 112 again detects the remaining sheet amount, and determines an increase/decrease in the remaining sheet amount (step S903). Here, if it is determined that the remaining sheet amount increased, the control unit 112 saves the added sheet amount in an item 803 in the paper feed tray database 800. The control unit 112 also saves the time when the user closed the paper feed tray in an item 804 in the paper feed tray database 800 (step S904). The control unit 112 furthermore measures the elapsed time from that time, and saves the measured elapsed time in the item 804 as well. When the user presses the OK button 604 in the paper feed tray setting screen 600 or the trays tab screen, the processing of FIG. 9 ends (step S905).

Paper Feed Tray Selection, Mode Check

Figure 10:
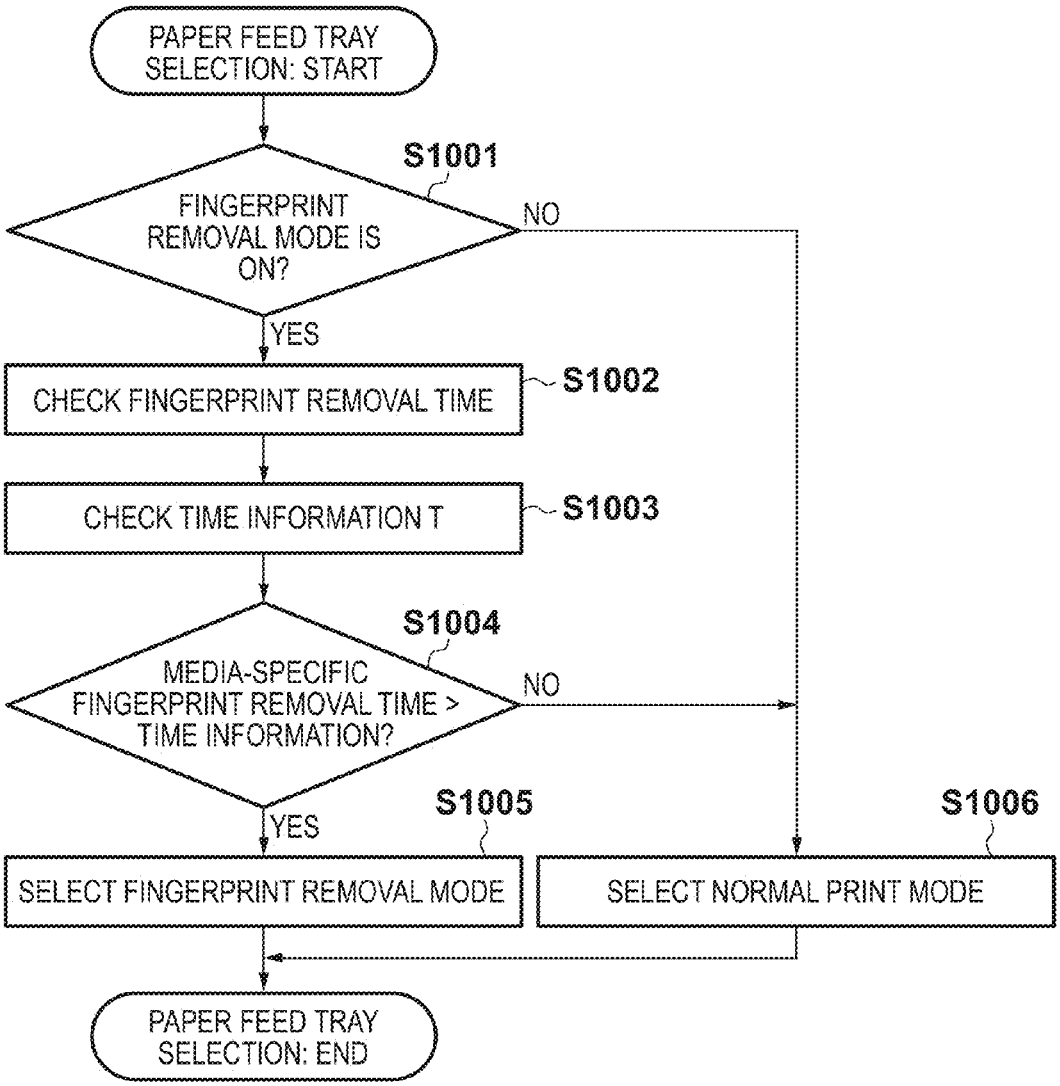
FIG. 10 is a flowchart showing a procedure of print mode selection processing according to Embodiment 1.

FIG. 10 is a flowchart showing a procedure of print mode selection processing performed by the image forming apparatus 104 according to the present embodiment. This procedure is executed by, for example, the CPU of the image forming apparatus 104 controlling various units of the image forming apparatus 104 shown in FIG. 1. As previously described, when printing is to be performed by the image forming apparatus 104, if the type of sheet (sheet type) to be used does not exist in a paper feed tray, the user associates a paper feed tray and a sheet type as shown in FIGS. 6 and 7. The processing of this flowchart is executed before printing if the sheet type designated in the print job exists in a paper feed tray. On the other hand, if the sheet type does not exist in a paper feed tray, this processing is executed when the user presses a media information button 402 in the job list 403.

If the user presses the media information button 402 in the job list 403, the control unit 112 displays the paper feed tray setting screen 600. When the media information button 402 is pressed by the user, information on the sheets in the paper feed trays connected to the image forming apparatus 104 is displayed on the paper feed tray setting screen 600 along with images of the paper feed trays, based on the paper feed tray database 800. If the user selects a paper feed tray button 601 on the paper feed tray setting screen 600 and then presses the OK button 604, the control unit 112 associates that paper feed tray with the print job that is the current processing target. At this time, the control unit 112 can also select multiple paper feed trays and assign them to the print job.

The control unit 112 determines whether or not the fingerprint removal mode item 801 in the paper feed tray database 800 saved in the image saving unit 111 is "ON" for the paper feed tray to be used in the print job (step S1001). If it is determined that the fingerprint removal mode item in the paper feed tray database 800 is "ON", the control unit 112 acquires the sheet type set in the paper feed tray selected by the user from among the sheet type items in the paper feed tray database 800.

Next, the control unit 112 searches for media information set for the paper feed tray in a table indicated as the sheet type database 1100 in FIG. 11, which is saved in the image saving unit 111 (step S1002). Sheet types 1101 for the sheet media and fingerprint removal times 1102, which are threshold values for determining whether fingerprint removal is to be performed, are associated with each other in the sheet type database 1100. Based on the paper feed tray database 800, the control unit 112 detects the elapsed time 804 since sheets were replenished in the paper feed tray (step S1003).

Based on the paper feed tray database 800, the control unit 112 compares the fingerprint removal time 1102 that corresponds to the sheet media set in the print job with the elapsed time since sheets were replenished, which is saved as the item 804 in the paper feed tray database 800 (step S1004). Here, if a certain time has not elapsed, that is to say, if the elapsed time is less than or equal to the threshold value, the control unit 112 selects the fingerprint removal mode as the print mode (step S1005). On the other hand, if a certain time has elapsed, it is determined that the fingerprints have disappeared, and the control unit 112 selects the normal print mode as the print mode (step S1006).

In the present embodiment, if a sheet shortage occurs during printing, and furthermore there is a paper feed tray having the same type of sheets as the type of sheets being used in printing, the control unit 112 switches to the paper feed tray having the same sheets set therein. In this case as well, the control unit 112 selects the print mode based on the flowchart in FIG. 10.

Printing Operations in Fingerprint Removal Mode

As was described with reference to FIG. 5, depending on the paper feed tray, a sheet passing along the paper feed conveyance path in the image forming apparatus 104 is vertically inverted and then conveyed to the fixer. In the present embodiment, the image forming apparatus 104 saves model (mechanism) information in correspondence with each paper feed tray as an item 805 in the paper feed tray database 800. Note that the built-in cassette 1 is associated with the paper feed cassette in FIG. 5, and the POD decks 1 to 3 are associated with the three levels of POD decks in the high capacity sheet feeding deck 513. Although not shown in FIG. 5, a built-in cassette 2 is a paper feed cassette that can be optionally attached to the image forming apparatus 104.

If the user touches a sheet bundle, fingerprints will be left on the upper surface of the sheet at the top of the sheet bundle and on the lower surface of the sheet at the bottom of the bundle. In the case of the conveyance path from the manual paper feed tray (first sheet storage unit) connected so as to supply sheets to the conveyance path 509 ("manual model"), sheets are not vertically inverted during conveyance in the image forming apparatus 104, and therefore the upper surface of the sheet at the top of the sheet bundle with fingerprints thereon comes into contact with the photosensitive drum 503 as the printing surface. Accordingly, if the selected paper feed tray is "manual model", printing is performed in the fingerprint removal mode when printing on the first printing medium sheet. Printing is then performed in the normal print mode from the second sheet onward.

On the other hand, in the case of the conveyance path from the built-in cassette (second sheet storage unit) connected so as to feed sheets to the conveyance path 510 ("inversion cassette"), the sheet is vertically inverted during conveyance before coming into contact with the photosensitive drum 503. Accordingly, printing is performed in the normal print mode when printing on the first printing medium sheet. Also, since the lower surface of the sheet at the bottom of the added sheet bundle is inverted, the lower surface with fingerprints thereon comes into contact with the photosensitive drum 503 as the printing surface. Accordingly, the control unit 112 calculates, as an approximate calculation, the number of printed sheets until the surface with fingerprints thereon will come into contact with the photosensitive drum, based on the added sheet amount indicated by the item 803 in the paper feed tray database 800. This can be calculated based on, for example, the number of pages that can be printed in the case where the paper feed tray is full of sheets, and the current remaining sheet amount (%). In the vicinity of the surface with fingerprints thereon (e.g., at the 5th to 10th page from that surface), the control unit 112 performs printing in the fingerprint removal mode. In this way, the image forming apparatus 104 switches the print mode according to the paper feed tray.

Figure 12:
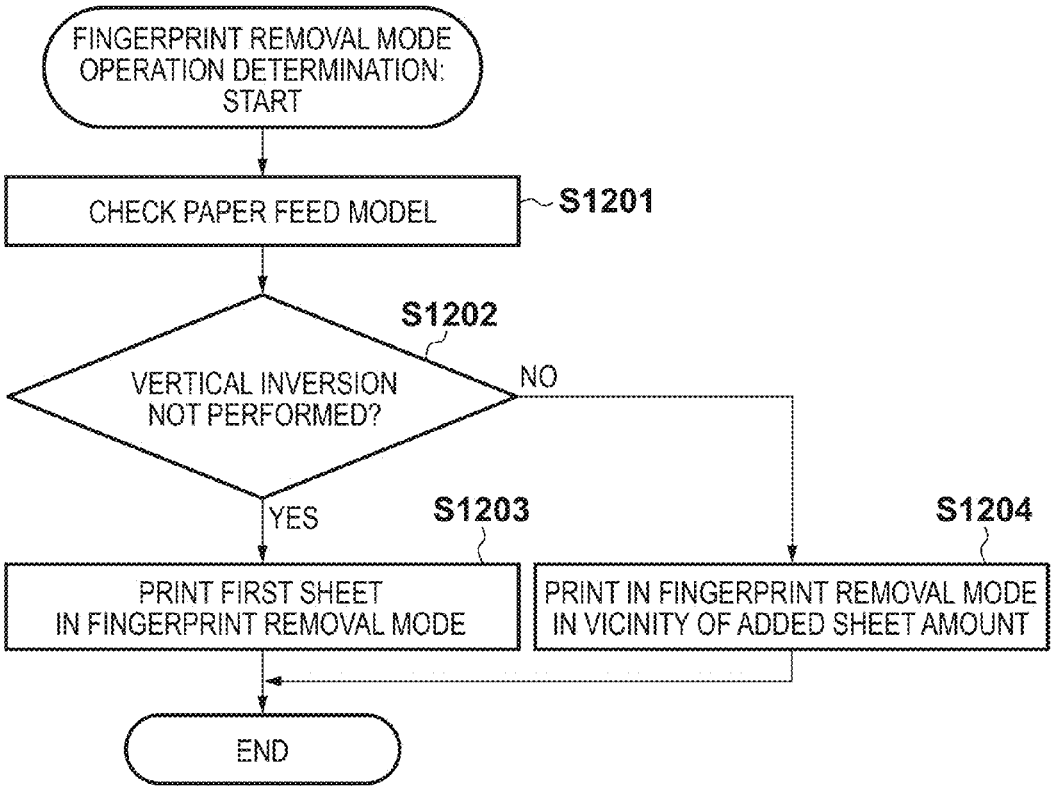
FIG. 12 is a flowchart showing a procedure of printing operation determination processing in a fingerprint removal mode.

FIG. 12 is a flowchart showing a procedure of printing operation determination processing (printing control method) in the fingerprint removal mode. This procedure is executed by, for example, the CPU of the image forming apparatus 104 controlling various units of the image forming apparatus 104 shown in FIG. 1. When the operation unit 110 displays the operation screen shown in FIG. 4, the control unit 112 starts the execution of this flowchart. The control unit 112 detects the model information of the paper feed trays based on the items 805 in the paper feed tray database 800 (step S1201). The control unit 112 determines whether or not the sheets in the paper feed trays will be vertically inverted in the conveyance paths based on the paper feed tray model information (step S1202). If it is determined that the printing medium in the conveyance path will not be vertically inverted in the conveyance path, the control unit 112 prints only the first sheet in the fingerprint removal mode (step S1203). This corresponds to the case where, for example, sheets are fed from the paper feed tray connected so as to feed sheets to the conveyance path 509 in FIG. 5. On the other hand, if it is determined that vertical inversion will occur, the control unit 112 performs printing in the fingerprint removal mode for the sheets in the vicinity of the added sheet amount (step S1204). This corresponds to the case where, for example, sheets are fed from the paper feed tray connected so as to feed sheets to the conveyance path 510 in FIG. 5.

Embodiment 2

Figure 13:
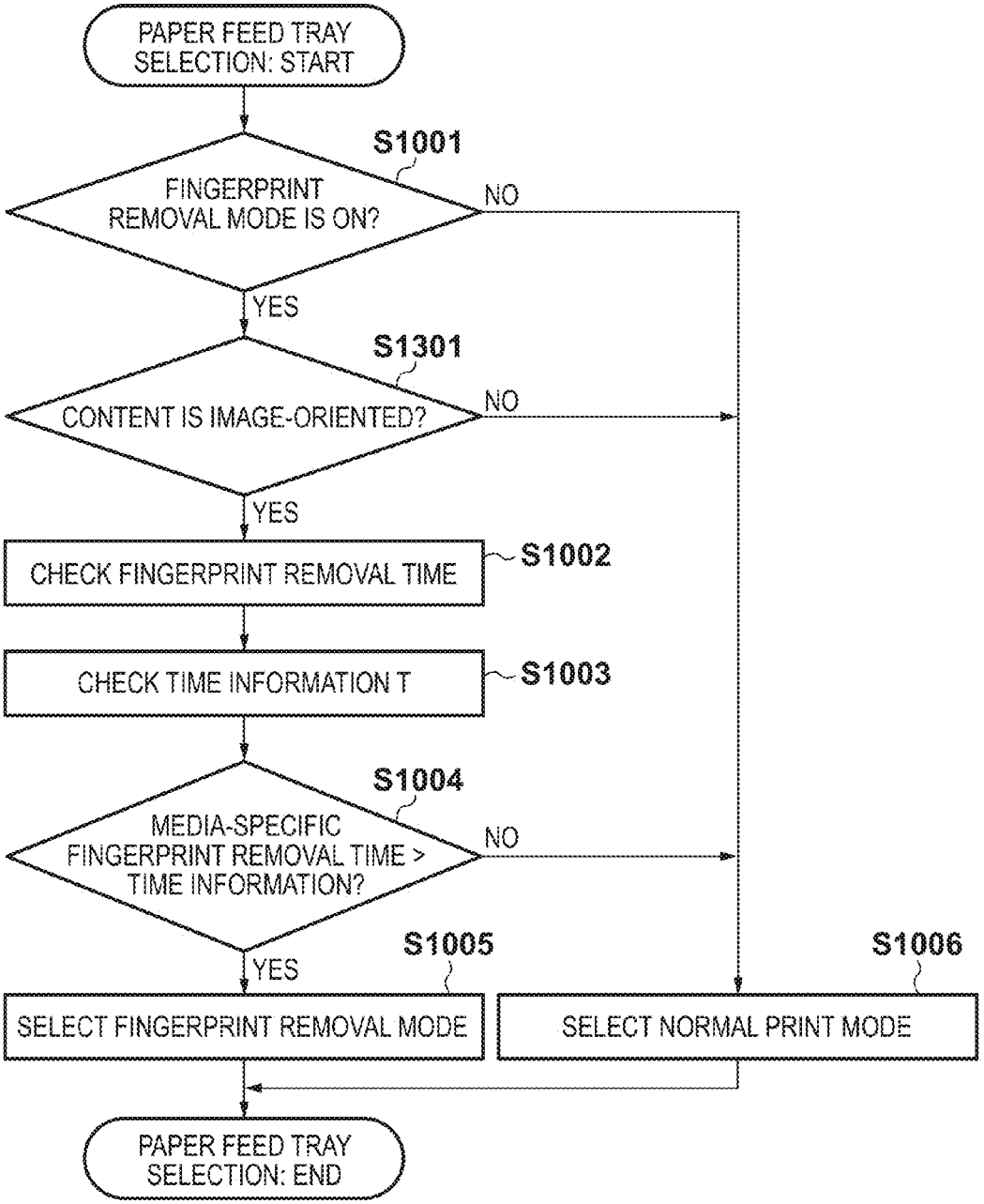
FIG. 13 is a flowchart showing a procedure of print mode selection processing according to Embodiment 2.

FIG. 13 is a flowchart showing a procedure of print mode selection processing performed by the image forming apparatus 104 according to the present embodiment. The present embodiment differs from Embodiment 1 with respect to the processing of step S1301 in FIG. 13.

In the present embodiment, the job interpretation unit 109 interprets the PDL code of a print job input from the client PC 101, and determines based on the interpretation result whether the print output information is character information or image information (one example of job determination). The result of this determination is used when the image forming unit 113 executes image forming processing. For example, if it is determined that the print output information is character information, filter processing is performed such that the character edges have a good appearance (edge processing). Also, if it is determined that the print output information is image information, filter processing is performed such that the image is smoother compared to peripheral pixels (smoothing processing).

Step S1301 in FIG. 13 is executed after it is determined in step S1001 that the fingerprint removal mode item 801 in the paper feed tray database 800 is "ON". When printing is to be performed, the image forming apparatus 104 then moves to step S1002 in order to change the print mode on a page-by-page basis based on the result of interpreting the PDL code in the print job input from the client PC 101. If the interpretation result indicates that the print output information is character information, the control unit 112 moves to step S1006 in order to select the normal print mode. On the other hand, if the interpretation result indicates that the print output information is image information, the control unit 112 selects the fingerprint removal mode. In the present embodiment, printing is performed in the fingerprint removal mode since the presence of fingerprints will be visually noticeable if the printing matter is an image (steps S1003-S1005). Also, if the printing matter is characters, printing is performed in the normal print mode since the presence of fingerprints will not be visually noticeable. As a result, efficiency can be improved by shortening the time required for print processing. Note that if it is determined in step S1301 that the print output information includes a combination of image information and character information, the procedure moves to step S1002 in order to select the fingerprint removal mode.

Embodiment 3

Figure 15:
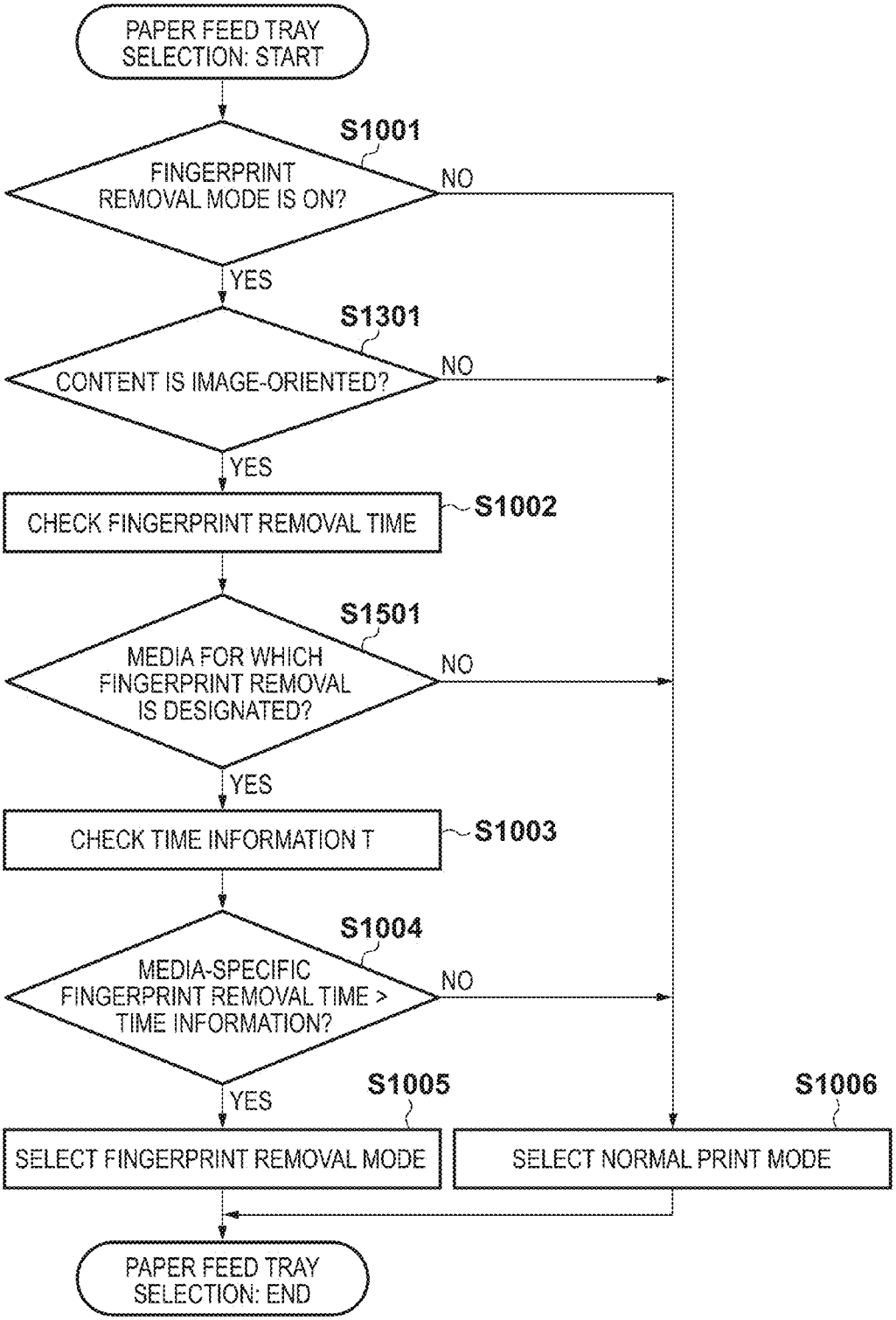
FIG. 15 is a flowchart showing a procedure of print mode selection processing according to Embodiment 3.
Figure 16:
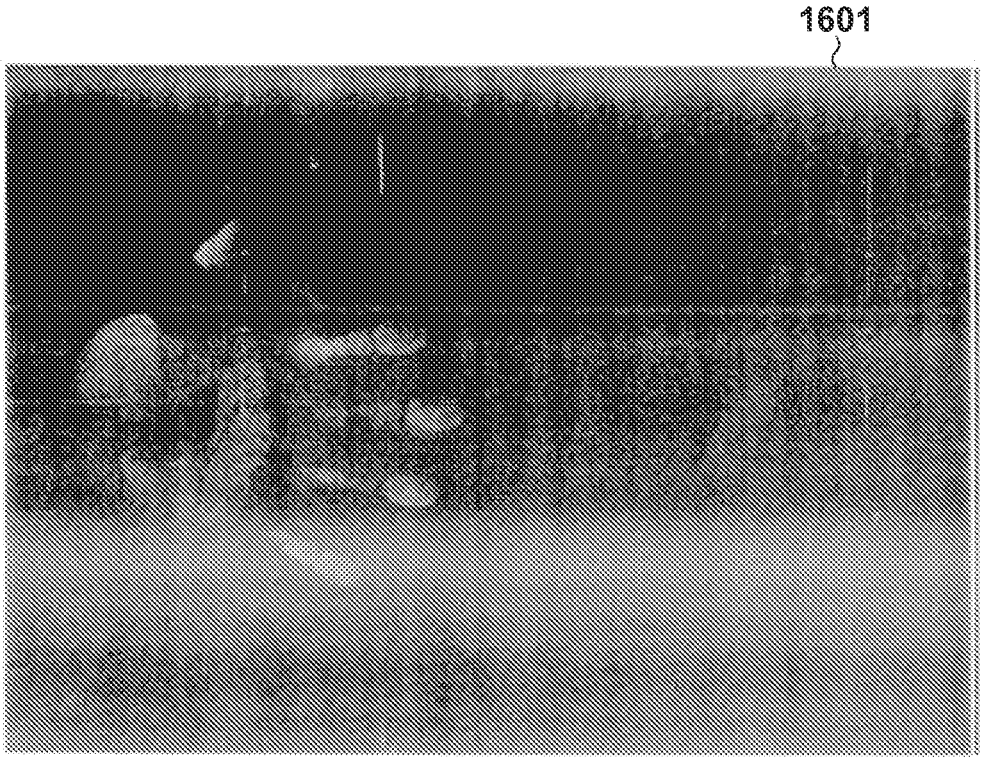
PRIOR ART FIG. 16
FIG. 16 is a diagram showing fingerprint marks left on printing matter.

FIG. 15 is a flowchart showing a procedure of print mode selection processing performed by the image forming apparatus 104 according to the present embodiment. The present embodiment differs from Embodiment 2 with respect to the processing of step S1501 in FIG. 15.

In the present embodiment, the image saving unit 111 manages sheet types 1101 for the sheet media and the fingerprint removal times 1102 in the sheet type database 1100. Sheet types such as "normal paper" and "recycled paper" are set as the sheet types 1101 associated in the sheet type database 1100.

Figure 14:
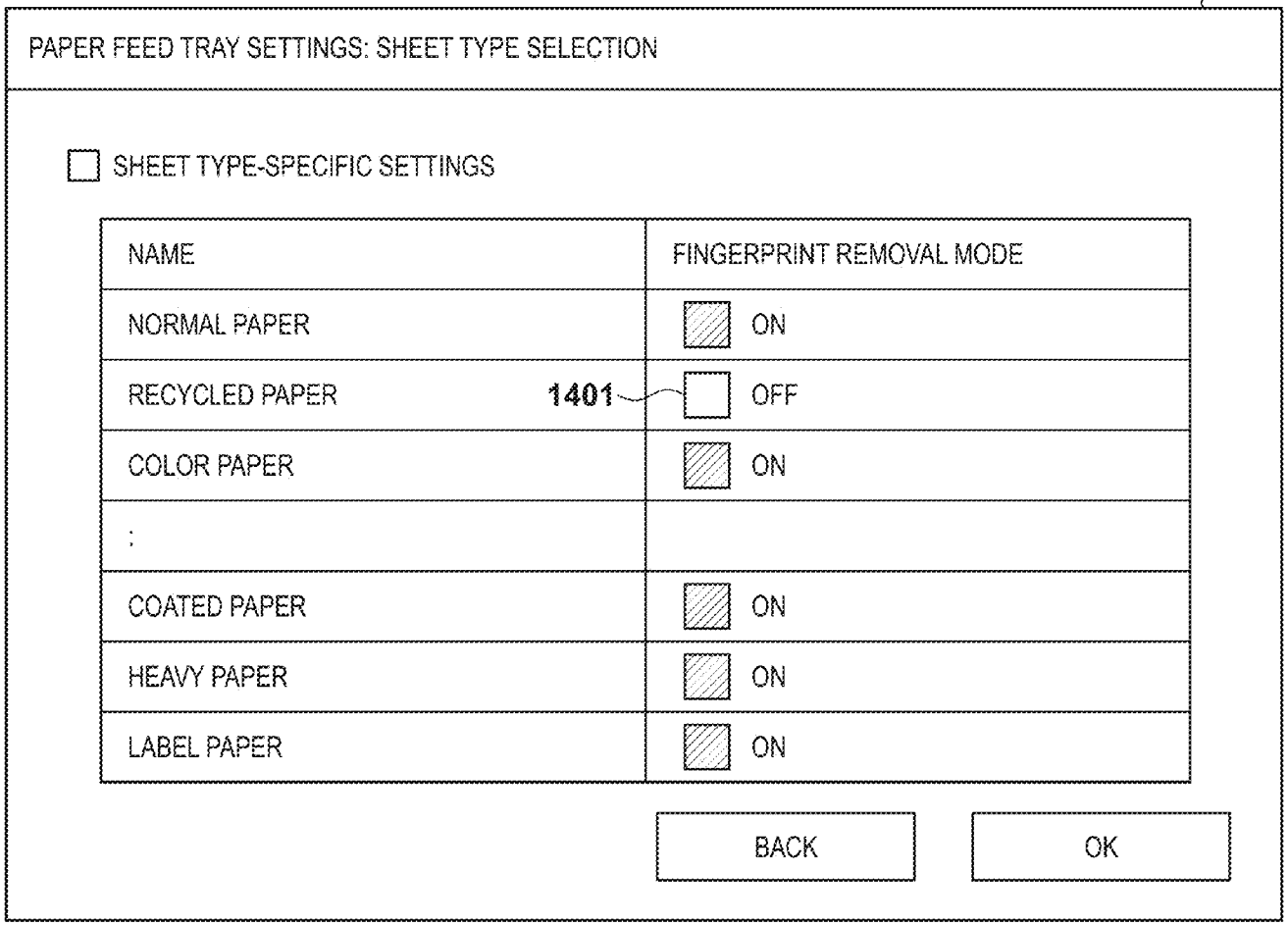
FIG. 14 is a diagram showing a sheet media setting screen displayed on the operation unit.

FIG. 14 is a diagram showing an example of a sheet media setting screen displayed on the operation unit 110 of the image forming apparatus 104. The setting screen in FIG. 14 is displayed when a sheet-specific detailed setting button 703 displayed on the sheet media setting screen 700 in FIG. 7 is pressed. The setting screen 1400 in FIG. 14 is displayed in the case where whether or not the fingerprint removal mode is to be implemented is to be set for each sheet type. By pressing fingerprint removal mode ON/OFF buttons 1401 displayed on the setting screen 1400, the user can set whether or not printing is to be performed in the fingerprint removal mode for each sheet type. If the user sets a fingerprint removal mode ON/OFF button 702 displayed on the sheet media setting screen 700 to "ON", that button is displayed in a grayed-out manner.

In the present embodiment, the image forming apparatus 104 can switch the print mode between the fingerprint removal mode and the normal print mode using the initial setting for each sheet type when performing printing. For example, a use mode is possible in which the fingerprint removal mode is not used in the case of performing printing with paper for which pre-printing is to be performed, such as recycled paper. In step S1501, the control unit 112 detects the sheet type of the printing medium set in the paper feed tray, and then moves to step S1003 in order to switch the print mode to the fingerprint removal mode depending on the sheet type.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-172301, filed Aug. 2, 2012, and 2012-172300, filed Aug. 2, 2012, which are hereby incorporated by reference herein in their entirety.

What is claimed is:

1. A printing apparatus comprising:

a printing unit configured to transfer an image to a sheet conveyed from a sheet storage unit and fix the transferred image to the sheet using a fixing unit;

a timer unit configured to measure an elapsed time since the sheet is set in the sheet storage unit;

a memory unit configured to store a threshold value associated with the elapsed time; and a control unit configured to determine, based on the measured elapsed time measured by the timer unit, whether or not to perform control such that the sheet is heated by the fixing unit before the image is transferred to the sheet, wherein the control is determined to be performed in a case where the measured elapsed time is less than or equal to the stored threshold value, and the control is determined not to be performed in a case where the measured elapsed time exceeds the stored threshold value.

2. The printing apparatus according to claim 1, wherein the memory unit is configured to store a plurality of threshold values in association with types of sheets, and the control unit is configured to select one of the stored plurality of threshold values in accordance with a type of the sheet set in the sheet storage unit.

3. The printing apparatus according to claim 2, wherein the control unit selects the threshold value to be a first value in a case where the type of the sheet set in the sheet storage unit is a first type, and selects the threshold value to be a second value in a case where the type of the sheet set in the sheet storage unit is a second type different from the first type.

4. The printing apparatus according to claim 1, wherein in a case where the measured elapsed time is less than or equal to the stored threshold value, the control unit performs control such that the sheet is heated with the fixing unit before the image is transferred to the sheet, the sheet is then conveyed via a double-sided conveyance path, and then the image is transferred to the conveyed sheet.

5. The printing apparatus according to claim 1, further comprising:

a determination unit configured to determine whether an image is to be printed on the sheet based on image data or an image is to be printed on the sheet based on character data, wherein in a case where the measured elapsed time is less than or equal to the stored threshold value and the determination unit determines that an image is to be printed on the sheet based on the image data, the control unit performs control such that the sheet is heated by the fixing unit before the image is transferred to the sheet, and in a case where the measured elapsed time is less than or equal to the stored threshold value and the determination unit determines an image is to be printed on the sheet based on the character data, the control unit performs control such that processing for heating the sheet with the fixing unit before the image is transferred to the sheet is not performed.

6. A method of controlling a printing apparatus, the method comprising:

a printing step of transferring an image to a sheet conveyed from a sheet storage unit and fixing the transferred image to the sheet using a fixing unit;

a measuring step of measuring an elapsed time since the sheet is set in the sheet storage unit; and a control step of determining, based on the measured elapsed time measured in the measuring step, whether or not to perform control such that the sheet is heated by the fixing unit before the image is transferred to the sheet, wherein the control is determined to be performed in a case where the measured elapsed time is less than or equal to a threshold value associated with the elapsed time, stored in a memory unit, and the control is determined not to be performed in a case where the measured elapsed time exceeds the threshold value.

7. A non-transitory computer readable storage medium storing a program for causing a computer to execute the method for controlling a printing apparatus, the method comprising:

a printing step of transferring an image to a sheet conveyed from a sheet storage unit and fixing the transferred image to the sheet using a fixing unit;

a measuring step of measuring an elapsed time since the sheet is set in the sheet storage unit; and a control step of determining, based on the measured elapsed time measured in the measuring step, whether or not to perform control such that the sheet is heated by the fixing unit before the image is transferred to the sheet, wherein the control is determined to be performed in a case where the measured elapsed time is less than or equal to a threshold value associated with the elapsed time, stored in a memory unit, and the control is determined not to be performed in a case where the measured elapsed time exceeds the threshold value.

8. The printing apparatus according to claim 1, wherein heating by the fixing unit before the image is transferred to the sheet is performed for removing a fingerprint mark.

* * * * *